United States Patent [19]

Farin

[11] 4,148,684

[45] Apr. 10, 1979

[54] METHODS FOR RECOVERY AND RECYCLING OF CHEMICALS FROM SODIUM SULFITE AND SODIUM BISULFITE PULPING OPERATIONS

[75] Inventor: William G. Farin, Neenah, Wis.

[73] Assignee: MEI Systems Inc., Menasha, Wis.

[21] Appl. No.: 840,996

[22] Filed: Oct. 11, 1977

Related U.S. Application Data

[63] Continuation-in-part of Ser. No. 739,719, Nov. 8, 1976, abandoned.

[51] Int. Cl.[2] ..... D21C 11/02

[52] U.S. Cl. ..... 162/36; 423/189; 423/207; 423/DIG. 3

[58] Field of Search ..... 162/36; 423/207, 209, 423/512 A, 438, 519, DIG. 3, 189

[56] References Cited

U.S. PATENT DOCUMENTS

| | | | |
|---|---|---|---|
| 2,792,350 | 5/1957 | Bradley et al. | 162/36 |
| 2,800,388 | 7/1957 | Ahlborg et al. | 162/36 |
| 2,841,561 | 7/1958 | Gray et al. | 162/36 |
| 2,993,753 | 7/1961 | Collins | 162/36 |
| 3,402,992 | 9/1968 | Ahlborg et al. | 162/36 |
| 3,508,863 | 4/1970 | Kiminki et al. | 162/30 R |
| 3,826,710 | 7/1974 | Anderson | 162/30 R |

*Primary Examiner*—S. Leon Bashore
*Assistant Examiner*—William F. Smith

[57] ABSTRACT

An improved method for recovering spent sodium and sulfur components in sodium sulfite and sodium bisulfite pulping operations. The method involves reduction burning of spent liquor to convert it to smelt and the treatment of this smelt in a sequence of operations that accelerate the reaction steps used to produce sodium hydrosulfide, hydrogen sulfide, sulfur dioxide, sodium carbonate, sodium bicarbonate and to recover sodium sulfite, sodium bisulfite, sodium carbonate and/or sodium hydroxide while preventing formation of sodium thiosulfate. The method utilizes a sufficient quantity of recycled sodium bicarbonate addition to precarbonated liquor to maintain the partial pressure of carbon dioxide created by the solution above that provided by the carbon dioxide in the gas used for stripping out the hydrogen sulfide, recovering the carbon dioxide and water vapor for stripping and precarbonation by decomposition of the sodium bicarbonate and recovering carbon dioxide by pressure decarbonation and pressure neutralization, for the high pressure carbonation to produce the sodium bicarbonate.

17 Claims, 3 Drawing Figures

METHODS FOR RECOVERY AND RECYCLING OF CHEMICALS FROM SODIUM SULFITE AND SODIUM BISULFITE PULPING OPERATIONS

BACKGROUND OF THE INVENTION

This is a continuation-in-part of copending application Ser. No. 739,719 filed Nov. 8, 1976, now abandoned.

Due to the high capital investment requirements for present methods of recovery of chemicals in sodium sulfite and sodium bisulfite pulping and the difficulties encountered in side reactions producing sodium thiosulfate that is detrimental to the pulp digesting operation, there is need for improved, lower cost methods of recovery of the sodium and sulfur components for reuse in the cooking operation. A process handling the evaporation and burning requirements has been disclosed and described in U.S. Pat. No. 3,638,708 and Canadian Pat. No. 906,394, "Methods of Multiple Stage Evaporation from Heat Sources Other than Steam." This system provides a self-sustaining method of evaporation and burning at low capital investment that recovers the chemicals in the form of smelt from sodium base operation but does not provide means for converting the chemicals back to the sodium sulfite and sodium bisulfite needed for cooking.

Recovered smelt or sodium sulfate have been utilized as makeup chemicals in Kraft mills, however, the limited market is being reduced by process improvements in Kraft operations to meet environmental requirements. Complete recovery of chemicals for sodium sulfite pulping is now essential to enable recovery of the chemical cost.

In existing processes used to recover the sodium sulfite chemicals, spent liquor is concentrated in an evaporator and burned in a recovery boiler or smelter in a reducing atmosphere to convert the sodium sulfur compounds to a smelt containing as high a percentage of sodium sulfide and sodium carbonate as possible in the conventional manner. A typical sodium bisulfite smelt concentration would include about 56% $Na_2S$, 34% $Na_2CO_3$, 6% $Na_2SO_4$, 2% $Na_2S_2O_3$, 2% NaOH. The smelt is discharged through a smelt spout to a smelt tank into water and mixed to form a 10% to 20% solution and heated to the 95° C. range. The solution then passes to a clarifier where impurities such as carbon and calcium salts are settled out and discharged from the bottom of the clarifier, with the clarified smelt removed at the top.

The most economical approach to the recovery of sodium sulfite is by wet carbonation but present methods require high capital investment, encounter side reactions that produce sodium thiosulfate which is very detrimental to pulp cooking, and form sodium bicarbonate crystals in the carbonation stages that cause plugging in the towers.

In the Mead process, U.S. Pat. No. 2,788,273 to Shick, smelt is carbonated with flue gas from liquor burning with the carbon dioxide utilized in a series of countercurrent towers to displace hydrogen sulfide and form sodium carbonate and sodium bicarbonate.

The Stora process, described in U.S. Pat. No. 3,098,710 to Ahlboy et. al., carbonates the smelt in a countercurrent tower with recycled carbon dioxide that displaces the hydrogen sulfide and forms sodium bicarbonate with the sulfur recovered in an expensive Clause reactor.

The Sivola method, Finnish Pat. No. 27,478, uses flue gas, then vented gas from decarbonation, for precarbonation and recycled pure carbon dioxide pressurized with a compressor for carbonation in a countercurrent tower displacing the hydrogen sulfide and forming sodium bicarbonate. The sodium bicarbonate formed is crystallized and filtered and used for acid makeup and liquor neutralization with the carbon dioxide recovered, stored at atmospheric pressure and recycled to carbonation.

Collins, U.S. Pat. No. 2,993,753, utilizes flue gas from liquor burning for sulfiting to remove the $SO_2$ then a portion of this gas is used for formation of sodium bicarbonate in a bicarbonating tower and a portion is used for counter-current hydrogen sulfide stripping in the carbonating tower. In addition to the sodium bicarbonate formed in the carbonating tower, a portion of the bicarbonate solution from the bicarbonating tower is recycled to facilitate removal of hydrogen sulfide in the carbonating tower. The balance of the sodium bicarbonate is used for sulfiting.

Gray, U.S. Pat. No. 2,841,561 uses a sequence of alternate hot pressure carbonation steps using flue gas from liquor burning, lime kiln or pure carbon dioxide from cylinders that must be pressurized mechanically wherein sodium bicarbonate is formed and followed by flash vacuum stripping of the hydrogen sulfide using steam to remove sulfides.

The Tampella process, U.S. Pat. No. 3,508,863 to Kiminki et. al., utilizes flue gas for precarbonation to form dissolved sodium bicarbonate, adds sodium bicarbonate to the solution and evaporates under vacuum to remove hydrogen sulfide and form and recover crystallized sodium carbonate. A portion of the sodium carbonate solution from the evaporator is carbonated with flue gas to form the sodium bicarbonate recycled.

Anderson, U.S. Pat. No. 3,826,710, uses a portion of the flue gas from the sulfur burner and pure carbon dioxide recycled from decarbonation for carbonation where hydrogen sulfide is displaced and burned in the sulfur burner. A portion of the gas from carbonation is also used for precarbonation with the hydrogen sulfide selectively removed and the carbon dioxide recycled back to carbonation.

The primary concern in recovery of chemicals is to avoid the side reactions to sodium thiosulfate formed when the sodium sulfide is allowed to contact the oxygen or sulfur dioxide which are present in the flue gas. It is also necessary to keep the sulfides out of the decarbonation or absorption stages.

In most of these processes, the hydrogen sulfide is displaced with carbon dioxide in the carbonation towers. This displacement is extremely slow as carbon dioxide is not as soluble as hydrogen sulfide and very large towers are required. When flue gas is utilized, the carbon dioxide partial pressure is only a fraction of one atmosphere and cannot be fully utilized as its concentration decreases as it is consumed. Carbonation in the towers to sodium bicarbonate concentration sufficient to displace hydrogen sulfide encounters crystallization and plugging in the towers and requires washing and dilution as the towers cannot be designed to handle the buildup encountered.

Collins adds sodium bicarbonate to the carbonation tower from a bicarbonating tower. Anderson and Sivola provide sodium bicarbonate from precarbanation to the carbonating tower. In each of these prior art patents, the low partial pressure of carbon dioxide available in forming the sodium bicarbonate in their initial operations is not of sufficient strength to fully remove the sulfides in the carbonating towers. Carbon dioxide absorption is thus required in the carbonation tower to replace sodium bicarbonate consumed in desulfiding and provide the solution partial pressures needed for complete disulfiding. The sodium bicarbonate formed also crystallizes at the low temperatures needed for carbonation causing scaling and plugging problems in the carbonation towers.

The Tampella system and Grays method avoid displacement of hydrogen sulfide with carbon dioxide by vacuum evaporation using steam, or heating a solution high in sodium bicarbonate content. However, the carbonation tower required to produce the sodium bicarbonate necessary to produce this high sodium bicarbonate content encounters the same crystallization and plugging problem as the carbonation tower displacing hydrogen sulfide. Flue gas with its limited carbon dioxide partial pressure does not provide the high solution sodium bicarbonate content needed for adequate displacement. Where used, the sodium bicarbonate must be crystallized and separated from the solution to provide concentrations suitable for hydrogen sulfide displacement. A single stage of vacuum evaporation is not sufficient to fully remove the hydrogen sulfide from the carbonated product and highly expensive crystallization of the sodium carbonate is utilized in the Tampella process to control the sodium thiosulfate content. Gray uses a series of carbonation and vacuum evaporation stages for sodium thiosulfate control, and this is expensive.

It is the purpose of this invention to provide a direct economical method of precarbonation, hydrogen sulfide stripping, carbonation, decomposition, decarbonation, neutralization and absorption without expensive countercurrent displacement of hydrogen sulfide with carbon dioxide or vacuum evaporation and the associated steam requirements for the recovery of sodium sulfite, sodium bisulfite, sodium carbonate and/or sodium hydroxide suitable for digester cooking and avoiding the sodium thiosulfate formation normally encountered.

SUMMARY OF INVENTION

In the recovery of chemicals according to this invention, the spent liquor from the digesters is first concentrated and burned in a reduction smelter or recovery boiler in the conventional manner to produce smelt with a high content of sodium carbonate and sodium sulfide and as low a content as possible of sodium sulfate and sodium thiosulfate. The smelt is then removed from the furnace and clarified.

To convert the sodium sulfide and sodium carbonate contained in the smelt to sodium sulfite, sodium bisulfite, sodium carbonate and/or sodium hydroxide, some or all of the following steps may be utilized. While eleven steps are listed, many of the steps are optional depending upon results desired or end products required and are, therefore, separately claimed since they are not necessary to the basic method but offer considerable flexibility of choice as indicated in the detailed description.

1. In the precarbonation step, the smelt solution containing sodium sulfide and sodium carbonate is contacted at the top of the precarbonation tower with a gas containing hydrogen sulfide and/or carbon dioxide causing the following reactions converting the sodium sulfide to sodium hydrosulfide:

$$Na_2S + H_2S = 2NaHS$$
$$2Na_2S + CO_2 + H_2O = Na_2CO_3 + 2NaHS$$

By venting the tower at the point where these reactions are essentially complete, the proportion of hydrogen sulfide and carbon dioxide consumed will be essentially the same as that vented from the tower and sent to the sulfur burning step. Below this point, carbon dioxide is also absorbed and consumed by the following reaction converting sodium carbonate to sodium bicarbonate:

$$Na_2CO_3 + CO_2 + H_2O = 2NaHCO_3$$

Over 65% of the sodium carbonate can be converted to sodium bicarbonate creating a demand for the carbon dioxide utilized in subsequent stripping operations.

2. In the first desulfiding step, the solution from the precarbonation step is mixed with a recycled carbonated solution containing a sufficiently high concentration of sodium bicarbonate to maintain the partial pressure of carbon dioxide and hydrogen sulfide created by the solution above that in the gas utilized for stripping in the desulfiding stripper. Under these conditions, both hydrogen sulfide and carbon dioxide are released in accordance with the following reactions:

$$NaHS + NaHCO_3 = Na_2CO_3 + H_2S$$

$$2NaHCO_3 = Na_2CO_3 + H_2O + CO_2$$

The sodium bicarbonate gives up its carbon dioxide very slowly so very little carbon dioxide is released. The reaction releasing hydrogen sulfide is rapid so the gas released can be about 95% hydrogen sulfide. The hydrogen sulfide reaction consumes both the sodium hydrosulfide and the sodium bicarbonate so the partial pressures of both hydrogen sulfide and carbon dioxide created by the solution are reduced by this reaction. As hydrogen sulfide is released, the concentration of hydrogen sulfide in the stripping gas contacted decreases and the concentration of carbon dioxide increases as the solution drops toward the bottom of the tower. To accelerate the reaction, water vapor is used in conjunction with the carbon dioxide for stripping, decreasing the partial pressures of the gases and increasing the temperature of the solution by condensation. The higher temperature increases the partial pressures of the carbon dioxide and hydrogen sulfide created by the solution to facilitate the reaction. The stripped hydrogen sulfide and carbon dioxide utilized for stripping are discharged for use in the precarbonation step.

3. In the carbonation step, all or a portion of the solution from the first desulfiding step containing sodium carbonate and sodium bicarbonate is pressure carbonated preferably utilizing carbon dioxide at pressures above 1.2 atmospheres from the pressure decarbonation step to provide a high concentration of sodium bicarbonate in accordance with the following reaction:

$$Na_2CO_3 + CO_2 + H_2O = 2NaHCO_3$$

All or a portion of the carbonated solution is mixed with the product from the precarbonation step and recycled back to the top of the first desulfiding stripper.

4. In the second desulfiding step, a portion of the product from the first desulfiding step or a portion of the product from the carbonation step, or a combination thereof is sent to the second desulfiding stripper where it is heated to the 95° C. to 100° C. temperature range and stripped with carbon dioxide and water vapor that is discharged with stripped hydrogen sulfide and utilized for the stripping in the first desulfiding stripper. Here again, the partial pressures of carbon dioxide and hydrogen sulfide created by the solution are held above that in the gas by the high concentration of sodium bicarbonate contained in the solution. Both hydrogen sulfide and carbon dioxide are released but the amount of carbon dioxide released is limited by the slow rate of reaction. Due to the faster reaction, the hydrogen sulfide is preferentially released depleating all the sodium hydrosulfide contained with the remaining traces of hydrogen sulfide stripped with the carbon dioxide and the water vapor utilized for heating both the second and the first desulfiding strippers. A portion of the solution containing a high concentration of sodium bicarbonate as well as sodium carbonate is discharged to the decarbonation step and the balance, if required, to the decomposition step.

5. In the decomposition step the solution from the second desulfiding stripper is heated under pressure to the 125° C. to 250° C. range to decompose the sodium bicarbonate and release carbon dioxide in accordance with the following reaction:

$$2NaHCO_3 = Na_2CO_3 + H_2O + CO_2$$

This solution is vented to an atmospheric flash tank releasing carbon dioxide and water vapor that is utilized for the heating and stripping in the second desulfiding stripper. Additional carbon dioxide can be added from the decarbonation step and/or the neutralization step. The sodium carbonate solution produced can be used for the decarbonation step, the neutralization step, or in the causticizing step to form sodium hydroxide for digester cooking or utilized directly as a portion of the solution for digester cooking.

6. In the decarbonation step a portion or all the solution from the second desulfiding stripper or a portion or all of the sodium carbonate solution from the decomposition step along with makeup sodium carbonate required is mixed with a circulating solution containing primarily sodium bisulfite from the absorption step or the fortification step to form sodium sulfite and release carbon dioxide by the following reaction:

$$Na_2CO_3 + 2NaHSO_3 = 2Na_2SO_3 + H_2O + CO_2$$

The reaction is carried out at pressures above 1.2 atmospheres, releasing carbon dioxide above 1.2 atmospheres for use in the carbonation step. This solution can then be discharged to a flash tank vented at one atmosphere with the carbon dioxide released utilized for the second desulfiding step.

7. In the neutralization step, neutralization of the sodium sulfite feed liquor before evaporation is desirable for sodium bisulfite or sodium acid sulfite applications to neutralize the acetic acid contained and avoid its release during evaporation and the subsequent secondary treatment requirements to satisfy the high oxygen demand of the acid condensate produced. A portion of the sodium carbonate from the decomposition step may be utilized for neutralization at pressures above 1.2 atmospheres releasing carbon dioxide that can be utilized at pressures above 1.2 atmospheres for the carbonation step. This neutralized liquor may also be vented at one atmosphere after pressure neutralization and the carbon dioxide released utilized in the second desulfiding stripper.

8. In the causticizing step, for alkaline sulfite applications, causticizing is accomplished by the conventional steps of slaking calcium oxide, utilizing a portion of the sodium carbonate solution from the decomposition step, to form calcium carbonate and sodium hydroxide in accordance with the following reaction:

$$Na_2CO_3 + Ca(OH)_2 = CaCO_3 + NaOH$$

The solution is clarified with the calcium carbonate removed from the bottom of the clarifier and the sodium hydroxide overflowing at the top for use in the digesters for cooking.

9. In the absorption step, an absorber is used to receive the flue gas from the liquor combustion system containing sulfur dioxide which is recovered by scrubbing with sodium sulfite solution from the decarbonation step, producing sodium bisulfite:

$$Na_2SO_3 + SO_2 + H_2O = 2NaHSO_3$$

A portion of the sodium bisulfite solution formed and/or a portion of the sodium sulfite solution going to the absorber may be utilized as the cooking chemical in the digester. A portion of the sodium bisulfite solution or sodium sulfite solution may also go to the fortification step to increase the acidity. The balance of the sodium bisulfite from the absorber recycles back for use in the decarbonation step.

10. In the sulfur burning step the hydrogen sulfide in the vented gas from the precarbonation step, along with makeup sulfur, is burned in a sulfur burner or in the liquor combustion furnace to form sulfur dioxide by the following reaction:

$$2H_2S + 3O_2 = 2SO_2 + 2H_2O$$

The sulfur dioxide obtained may go to the absorption step or to the fortification step.

11. In the fortification step, the sulfur dioxide from sulfur burning is absorbed in the sodium bisulfite and/or sodium sulfite solution from the absorption step, or from the decarbonation step, to strengthen the acid for sodium acid sulfite or sodium bisulfite cooking. The product from fortification is then used in the digester. A portion of this product may also be recycled back to the decarbonation step. The gases from fortification may vent to the absorption step.

The acidity of the recovered chemicals may be varied in the use of fortified sodium bisulfite, sodium bisulfite, sodium sulfite, sodium carbonate and/or sodium hydroxide. The invention permits a very versatile and economical sodium base recovery system for acid sulfite, bisulfite, neutral sulfite and alkaline sulfite applications. Higher alkaline sulfite pulping is an interesting potential utilizing the sodium sulfite and sodium hydroxide for the replacement of Kraft pulping. This will eliminate the sulfide odor problems usually associated with Kraft pulping.

The invention avoids sodium thiosulfate formation by using pure carbon dioxide and avoiding the use of flue gases that contain oxygen and sulfur dioxide in the precarbonation, carbonation and stripping where contact with the sulfides cause sodium thiosulfate formation. It provides more complete and efficient carbonation with controlled crystallization using pure pressurized carbon dioxide supplied by new methods of pressurized decarbonation and pressurized neutralization. It provides new methods of more efficient stripping of hydrogen sulfide by controlling the partial pressure of carbon dioxide and hydrogen sulfide created by the solution above that in the gas contacted by recycling the high concentrations of sodium bicarbonate made possible by pressure carbonation. This prevents carbonation and the resulting crystallization and scaling in the stripper. The improved stripping efficiency prevents sulfides from entering the decarbonation stages where contact with sodium bisulfite would produce sodium thiosulfate. New methods are also provided the recovery of carbon dioxide from sodium bicarbonate solutions using heat decomposition with full heat utilization by using the vented carbon dioxide and water vapor for stripping.

Other additional advantages of the invention will become apparent to persons skilled in the art on referring to the following detailed specifications and accompanying drawings.

DETAILED DESCRIPTION OF THE PREFERRED EMBODIMENTS

Figure 1:
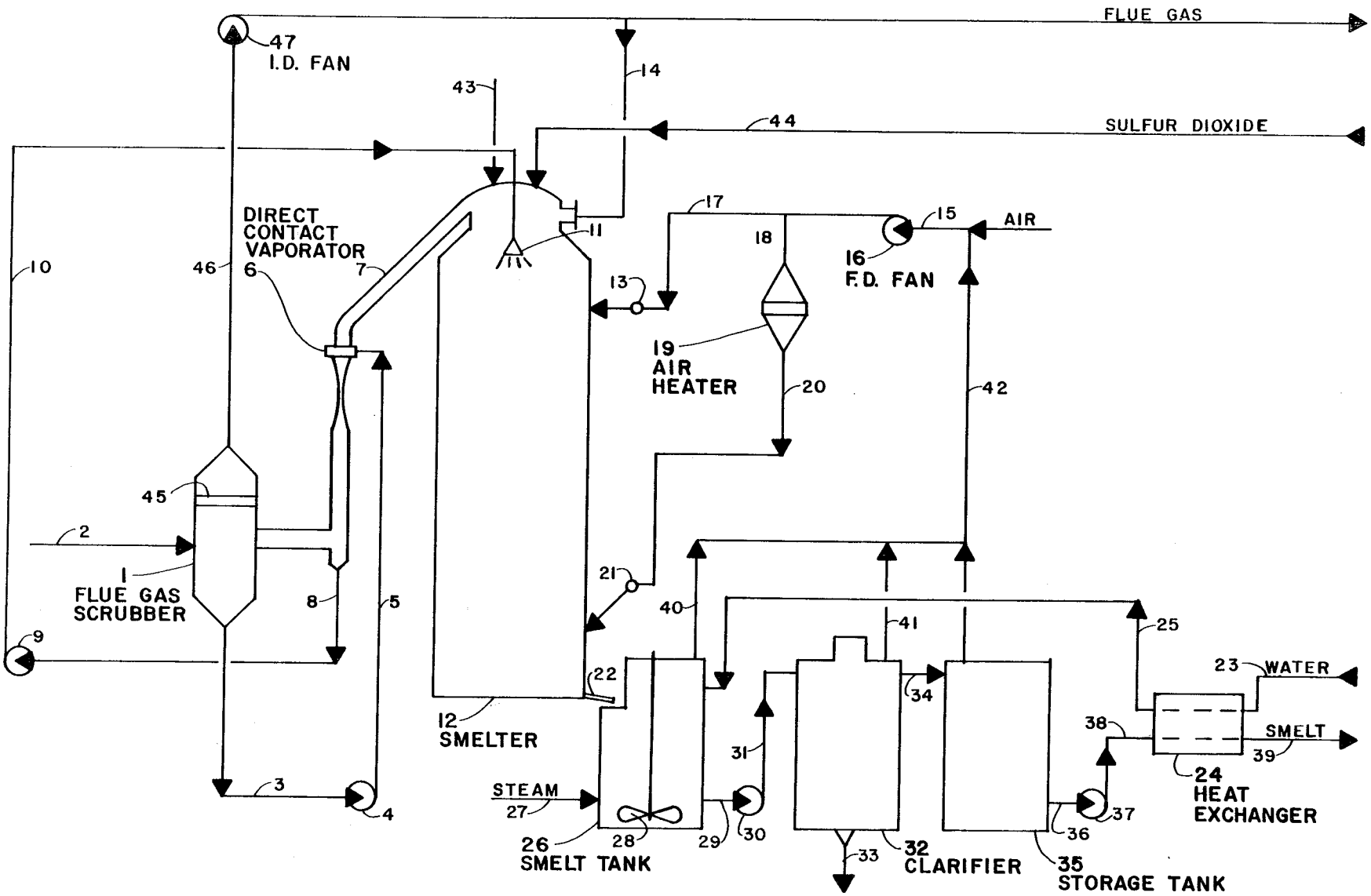
FIG. 1 is a schematic flow diagram showing spent liquor direct contact evaporation, incineration, reduction burning, recovering and clarifying smelt.

In the arrangement shown in FIG. 1 for a 250 ton per day pulp mill, neutralized spent sodium sulfite liquor at 17.9% concentration, and a rate of 65,034 lbs./hr. is fed to the flue gas scrubber 1, through inlet line 2. The spent liquor is circulated through discharge line 3, pump 4 and carried through line 5 to the direct contact evaporator 6. Here it is contacted with flue gas at 500° C. supplied through duct 7 to the direct contact evaporator. The liquor concentrated to 55% solids is removed through line 8, pump 9 and is discharged through line 10 to the burner 11. The liquor is incinerated in the smelter 12 using a slight excess of air supplied through secondary air port 13 oxidizing the volatiles and producing carbon dioxide and sulfur dioxide in the flue gas. The discharged flue gas is cooled by recycle flue gas from duct 14 and discharged through duct 7.

Air is supplied through intake 15 by forced draft fan 16 and through duct 17 to secondary air port 13. Primary air is supplied through duct 18, is heated in air heater 19 to 160° C. and passes through duct 20 to primary air port 21. The partially incinerated liquor and solids drop to the bottom of the smelter and are incinerated in a reducing atmosphere by a limited amount of air supplied through primary air port 21. This reduces about 90% of the sodium sulfur salts contained to sodium sulfide. A typical smelt analysis for neutralized liquor is 51.3% sodium sulfide, 42.6% sodium carbonate, 4.7% sodium sulfate and 1.4% sodium thiosulfate. This molten smelt at a rate of 2,780 lbs./hr. is discharged through the smelt spout 22 in the conventional manner and mixed with water supplied through line 23, heated by heat exchanger 24 and passed through line 25 to the smelt tank 26 where the smelt is heated further to 95° C. by steam added through line 27 and mixed to an 11.9% solids concentration by mixer 28.

The smelt solution is discharged at 42 GPM through line 29, pump 30 and line 31 to the clarfier 32 where impurities are removed through discharge line 33. The clarified smelt overflows through line 34 to storage tank 35 and is discharged through line 36, pump 37 and line 38 to heat exchanger 24 where it is cooled to 37° C. and supplied to the sodium sulfite recovery system through line 39.

The smelt tank 26, clarifier 32 and storage tank 35 are vented using lines 40, 41 and 42 to the air intake 15 so any hydrogen sulfide vented is carried with the air to the smelter 12 for oxidation and formation of sulfur dioxide using the excess secondary air provided through port 13.

The flue gas from combustion in the smelter 12 is discharged through duct 7. Digester blow gases may be added through inlet duct 43 and sulfur burner flue gas may be added through inlet duct 44 for recovery of heat and the sulfur dioxide. The flue gas used for evaporation in direct contact evaporator 6 passes to flue gas scrubber 1 saturated at 89° C. and is drawn through demister 45 and duct 46 by induced draft fan 47 and discharged through duct 48 to the absorber with a portion recycled through duct 14.

In the arrangement shown in FIG. 2 for a 250 ton per day pulp mill utilizing sodium acid sulfite or bisulfite with pH below 6, clarified smelt at 42 GPM, 11.9% solids concentration and 37° C. from line 39 in FIG. 1 is supplied through feed line 101 to precarbonator 102 through spray nozzle 103. In chamber 104, it contacts gas containing about 75% hydrogen sulfide and 25% carbon dioxide at atmospheric pressure. Both gases are absorbed and react with the sodium sulfide converting it to sodium hydrosulfide. A very small amount of gas can be vented through line 105, however, valve 106 can also be closed and the top of the precarbonator deadened. The balance of the gas containing 622 lbs./hr. of hydrogen sulfide and 207 lbs./hr. of carbon dioxide is vented through line 107 to line 271 and sulfur burner 272 shown on FIG. 3. The reacted smelt passes through packing chamber 108 where it is contacted by the gas entering through line 109 containing 1033 lbs./hr. of hydrogen sulfide and 790 lbs/hr. of carbon dioxide. About 71% of the sodium in the sodium carbonate contained is converted to sodium bicarbonate by the carbon dioxide absorbed. A carbon dioxide gas partial pressure condition of from 0.1 to 0.2 atmospheres is maintained by the gas above that created by the solution to facilitate this initial precarbonation reaction. The sodium bicarbonate content is still within the solubility range so no crystals are formed in the precarbonation tower.

The precarbonated solution heated to 50° C. by the reaction and the solids content increased to 16.5% by the absorption is discharged at 42 GPM through line 110 by pump 111 and line 112 to line 113 where it is mixed with 192 GPM of carbonated solution at 75° C. wherein over 90% of the carbonated sodium contained has been converted to sodium bicarbonate. This mixture enters No. 1 stripper 114 through spray nozzle 115. The gases are discharged through line 116 to condenser 117 cooled by water entering through line 118 and discharged through line 119. The gases cooled to 40° C. are discharged through line 109 to precarbonator 102. The 386 lbs./hr. of water condensed is discharged through line 120 back to No. 1 stripper 114.

Due to the high percentage of sodium bicarbonate contained in the mixed solution going to the top of No. 1 desulfiding stripper, the partial pressure of carbon dioxide created by the solution would theoretically be about 2.5 atmospheres above that in the gas. The partial pressure of the hydrogen sulfide in the solution is also well above that in the gas. Both carbon dioxide and hydrogen sulfide are released, however, due to the much faster hydrogen sulfide reaction, more than 90% of the gas released is hydrogen sulfide. The reactions releasing hydrogen sulfide as well as carbon dioxide consume sodium bicarbonate and form sodium carbonate rapidly reducing the partial pressures of both the carbon dioxide and hydrogen sulfide created by the solution. This is partially compensated for by heating the solution with the water vapor also utilized for stripping to 85° C. About 70% of the sulfur is released as hydrogen sulfide in No. 1 desulfiding stripper. At this point, the partial pressure of hydrogen sulfide created by the solution has been reduced to about that provided in the gas. The partial pressure of carbon dioxide created by the solution, however, remains above that provided by the gas used for stripping during the entire stripping operation so no carbonation takes place in the stripper. The gas utilized for stripping enters No. 1 stripper 114 through line 122 from No. 2 stripper 123. This gas contains 307 lbs./hr. of hydrogen sulfide, 718 lbs./hr. of carbon dioxide and 4,011 lbs/hr. of water vapor at 97° C.

The product from No. 1 stripper is discharged at 85° C. through line 124 by pump 125 to line 126. About 21% of the product goes through valve 127 and line 128 to No. 2 desulfiding stripper 123. The balance of the product passes through line 129 and is cooled in heat exchanger 130° to 50° C. and discharged through line 131 to pressure carbonator 132.

The pressure carbonator is operated at pressures above 1.2 atmospheres to increase carbon dioxide absorption and the rate of reaction and convert at least 90% of the carbonated sodium contained to sodium bicarbonate. The circulated solution rises through retention chamber 133 holding sodium bicarbonate crystals in suspension and removing supersaturation from the solution. The solution overflows through line 134 and is circulated by pump 135 through line 136 and cooler 137. The solution is cooled to 40° C. in the indirect exchanger by cooling water entering through line 138 and discharging through line 139.

Contact between the solution containing sodium carbonate with carbon dioxide at pressures above 1.2 atmospheres is carried out in an ejector 140. Ejector 140 has a liquor inlet 141, which receives the circulating flow of the solution from cooler 137 creating the motivating force for a suction inlet line 142. Carbon dioxide is drawn in through suction inlet 142 and mixed with the solution. The solution and carbon dioxide is then discharged through line 143 to separator 144. Excess carbon dioxide is vented to the ejector 140 through lines 145, 146, and 142. Saturated solution and crystals of formed sodium bicarbonate are discharged down a drop leg 147 to the suspension chamber 133 creating an upflow in the suspension chamber holding formed sodium bicarbonate crystals in suspension. This provides the holdup time needed to carbonate sodium carbonate to sodium bicarbonate, remove the supersaturation created by the sodium bicarbonate formed with the crystals held in suspension and provides the nuclei for crystallizing additional sodium bicarbonate. It creates a solution with at least 90% of the carbonated sodium contained converted to sodium bicarbonate. Carbon dioxide with some hydrogen sulfide contained is vented through line 146 and recycled through line 142 to ejector 140. 913 lbs./hr. of carbon dioxide are consumed by the reaction forming 1,046 lbs./hr. of sodium bicarbonate. A small amount of carbon dioxide may be vented through valve 148 and line 149 to provide a slight purge to line 122.

A portion of the circulating sodium bicarbonate solution formed and the crystals contained is removed at 192 GPM through line 150 at 40° C. and heated to 75° C. in heat exchanger 130 dissolving the crystals and increasing the sodium bicarbonate concentration in the solution. It is then discharged through line 151 and mixed with precarbonated solution supplied through line 112 in line 113 discharging to the top of No. 1 desulfiding stripper 114. A portion of the solution may also be discharged through valve 152 to line 128 going to No. 2 desulfiding stripper 123.

The partially stripped solution from line 128 enters No. 2 desulfiding stripper 123 through spray nozzle 153 and is stripped in packing chamber 154 with 637 lbs./hr. of carbon dioxide and 4,764 lbs./hr. of water vapor supplied through line 155. At the top of the stripper, the partial pressure of carbon dioxide created by the solution is held theoretically, at least one atmosphere above that provided by the gas so the hydrogen sulfide partial pressure created by the solution is also held above that provided by the gas with the hydrogen sulfide preferentially released. The temperature increases to 99° C. at the bottom of the stripper with the partial pressure of carbon dioxide created by the solution remaining above that provided by the gas so no carbonation is encountered. This carbon dioxide partial pressure differential can be increased by allowing a portion of the carbonated solution from carbonation to pass through valve 152 to increase the sodium bicarbonate content in the feed to No. 2 desulfiding stripper. By utilizing gas and water vapor essentially free of hydrogen sulfide for stripping, the partial pressure of hydrogen sulfide created by the solution remains above that provided by the gas as long as sulfides remain in the solution, reducing the sulfide content in the solution to an absolute minimum.

The stripped sodium bicarbonate solution from No. 2 desulfiding stripper 123 is removed through line 156, discharged by pump 157 at 11 atmospheres pressure with a portion going through line 158, valve 159 and line 160, to high pressure decarbonation. The balance of the solution passes through valve 161 and line 162 and is heated to 185° C. in ejector 163 by 150 psig steam at 937 lbs./hr. entering through line 164. The heated solution passes through line 165 to carbon dioxide release chamber 166. The sodium bicarbonate is decomposed and the released carbon dioxide and sodium carbonate solution are discharged through line 167 and reducing valve 168 to flash tank 169 with the carbon dioxide and water vapor released at slightly above one atmosphere pressure through lines 170 and 155 for use in No. 2 desulfiding stripper 123. An additional 443 lbs./hr. of carbon dioxide is supplied through line 171 and line 155 for use in No. 2 desulfiding stripper 123.

The sodium carbonate solution formed is discharged through line 172 by pump 173 with a portion removed through valve 174 and line 175 for use in feed liquor neutralization. A portion of the sodium carbonate solution can also be discharged through valve 176 and line 177 for use in digester cooking if required, for causticizing to form sodium hydroxide for use in the digester for alkaline sulfite pulping or for a final stage of sulfur dioxide absorption if required.

Figure 2:
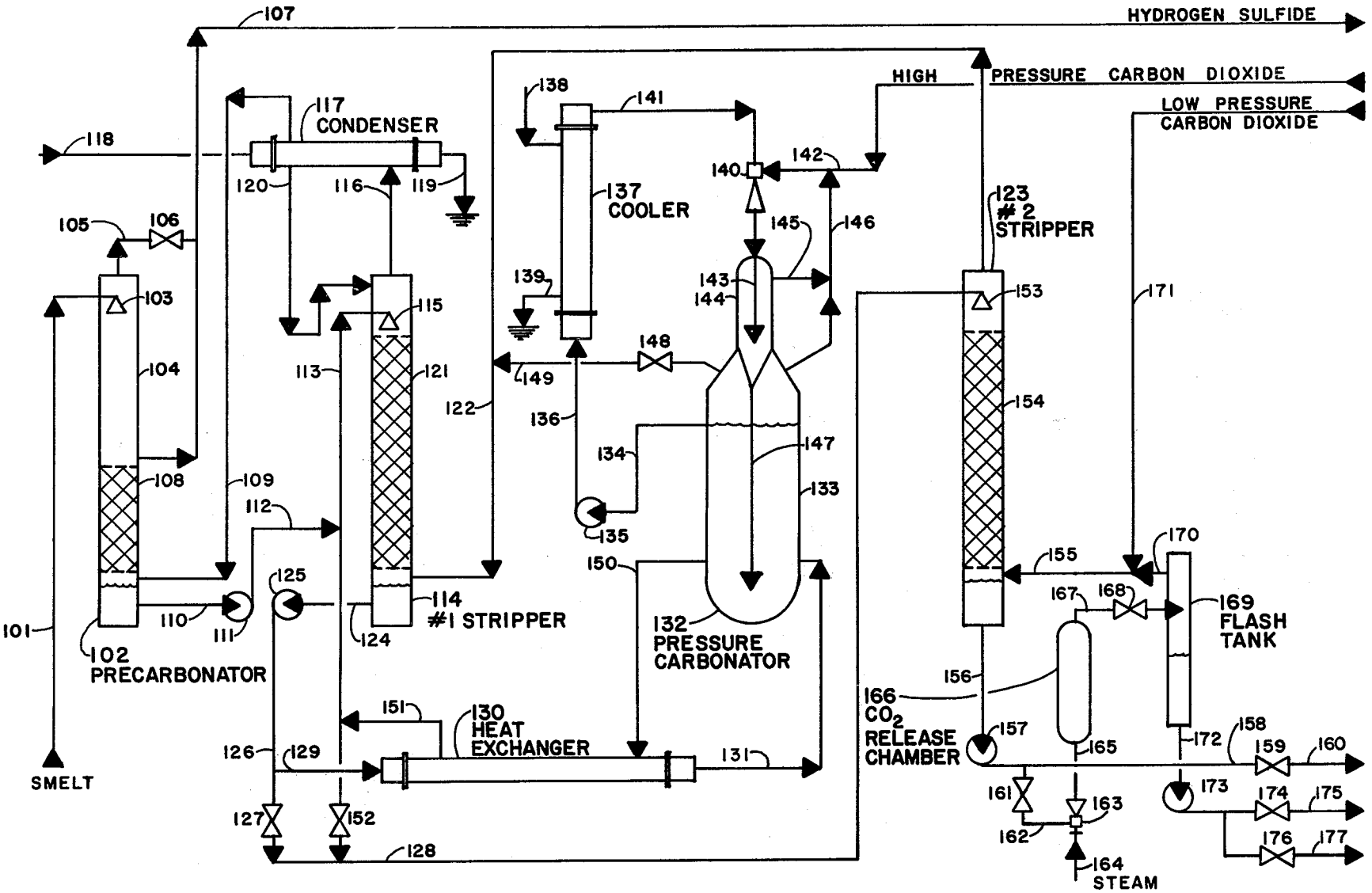
FIG. 2 is a schematic flow diagram showing the precarbonation, stripping, carbonation and decomposition steps in the recovery of sodium and sulfur components.
Figure 3:
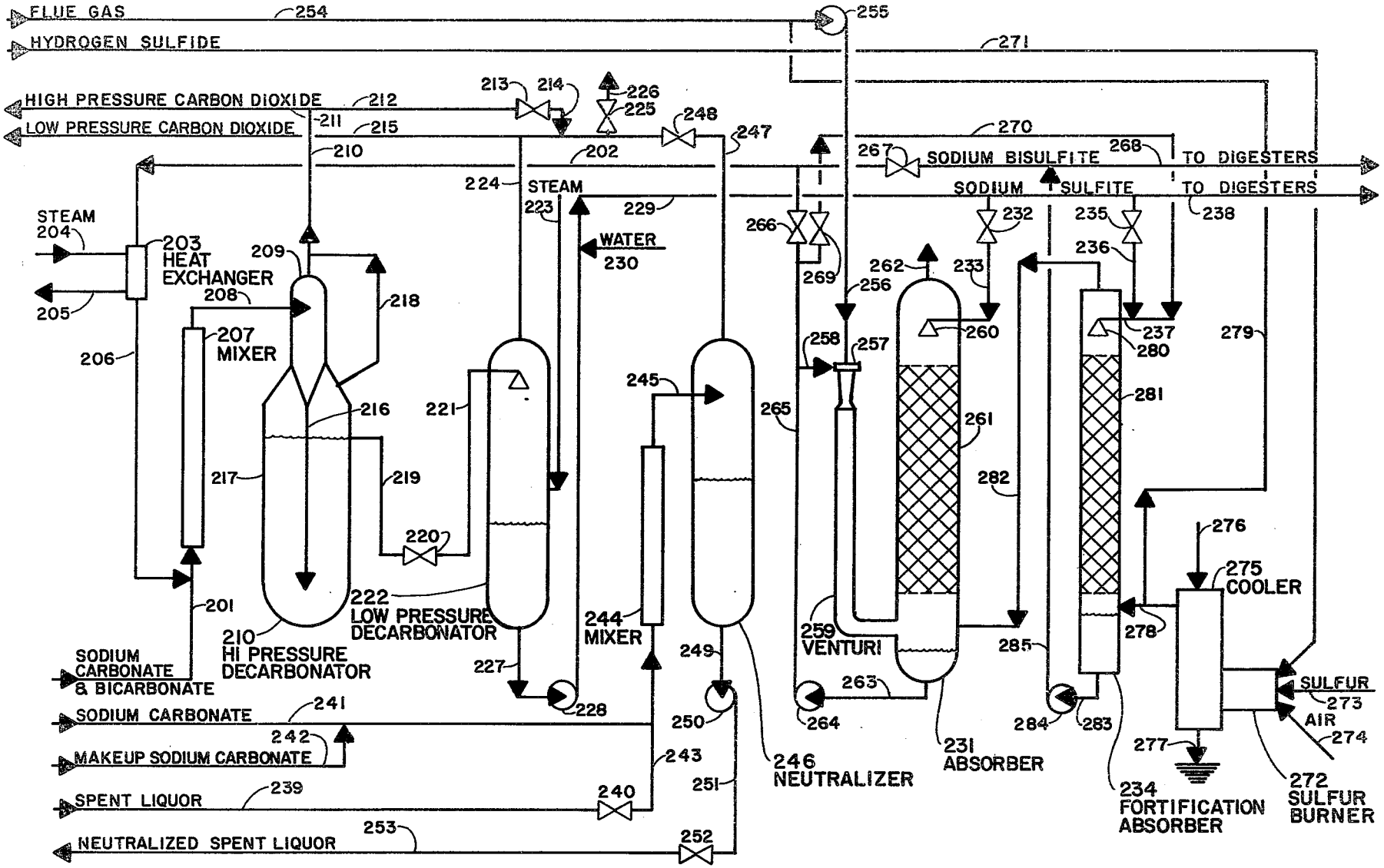
FIG. 3 is a schematic flow diagram showing recovery of the sodium and sulfur components incorporating the present invention for the recovery of sodium bisulfite or sodium acid sulfite cooking liquor.

In the arrangement shown in FIG. 3, the sodium carbonate, sodium bicarbonate solution discharged through line 160 in FIG. 2, enters through line 201 at pressures above 1.2 atmospheres. Sodium bisulfite solution supplied through line 202 is heated in indirect heat exchanger 203 to 100° C. by steam supplied through line 204 with condensate discharged through line 205. The heated sodium bisulfite solution passes through line 206 and combines with the sodium carbonate, bicarbonate solution in line 201 going to mixer 207 and line 208 to separator 209 of high pressure decarbonator 210. The sodium carbonate and sodium bicarbonate react with the sodium bisulfite to form sodium sulfite and release carbon dioxide and water vapor at above 1.2 atmospheres pressure through line 210 with 913 lbs./hr. of carbon dioxide supplied through high pressure carbon dioxide header 211 to line 142 in FIG. 2 to carbonator ejector 140. Excess carbon dioxide is discharged through line 212, valve 213 and line 214 to low pressure carbon dioxide header 215.

The sodium sulfite solution formed discharges through drop leg 216 to retention chamber 217 with released carbon dioxide vented through line 218. The sodium sulfite solution overflows through line 219 and reducing valve 220 where the pressure is reduced to slightly above one atmosphere and passes through line 221 to low pressure decarbonator 222. 3892 lbs./hr. of steam is added through line 223 and the carbon dioxide is stripped with the water vapor and discharged through line 224 with 443 lbs./hr. of carbon dioxide and 3892 lbs./hr. of water vapor discharged through low pressure carbon dioxide header 215 to line 171 in FIG. 2 for use in #2 desulfiding stripper #123. Excess carbon dioxide is vented through pressure regulating valve 225 and line 226.

The sodium sulfite solution formed is discharged from low pressure decarbonator 222 through line 227 by pump 228 through line 229 with dilution water added through line 230. A portion may be utilized in absorber 231 entering through valve 232 and line 233. A portion may also be utilized in fortification absorber 234 entering through valve 235 and lines 236 and 237. A portion may also be discharged through line 238 for use in the digesters for cooking.

Spent cooking liquor from the digesters enter through line 239 and valve 240 and sodium carbonate solution entering from line 175 in FIG. 2 through line 241 and makeup sodium carbonate supplied through line 242 are combined in line 243 going to mixer 244 and pass through line 245 to neutralizer 246. The sodium carbonate reacts with the acetic acid contained in the spent liquor neutralizing the liquor and releasing carbon dioxide. If reacted at one atmosphere pressure, 314 lbs./hr. of carbon dioxide and 69 lbs./hr. of water vapor are released through line 247 and valve 248 providing an addition supply to low pressure carbon dioxide header 215. This provides an excess of carbon dioxide of 443 lbs./hr. ordinarily vented through valve 225 and line 226. Neutralization can also be carried out at pressures above 1.2 atmospheres to provide additional carbon dioxide if needed to the high pressure carbon dioxide header for pressure carbonation. Neutralized liquor is discharged through line 249 by pump 250 through line 251, valve 252 and line 253 to the evaporation and burning system entering through line 2 in FIG. 1.

Flue gas from the burning system discharged through line 48 in FIG. 1 enters through line 254 drawn by absorber fan 255 discharging through line 256 to venturi scrubber 257 where it is scrubbed with sodium bisulfite solution entering through line 258 for particulate removal and discharging through line 259 to absorber 231. The flue gas is scrubbed with sodium sulfite solution entering through line 233 and spray nozzle 260 in packing chamber 261 recovering the sulfur dioxide. The flue gas is vented through line 262.

The sodium bisulfite formed by the reaction is discharged through line 263 by pump 264 and line 265 with a portion recycled through line 258 for scrubbing in venturi scurbber 257. A portion is also discharged through valve 266 and line 202 for use in the high pressure decarbonator 210. A portion may also be discharged through valve 267 and line 268 for use in the digesters for cooking. A portion may also be discharged through valve 269, lines 270 and 237 for use in the fortification absorber 234.

Hydrogen sulfide from line 107 in FIG. 2 enters through line 271 and is burned in sulfur burner 272 along with makeup sulfur supplied through line 273 utilizing air supplied through line 274. The sulfur dioxide formed is cooled in cooler 275 with water supplied through line 276 and discharged through line 277. The sulfur dioxide formed is discharged through line 278 to fortification absorber 234. When no fortification absorber is required, the sulfur dioxide is discharged through line 279 to line 254, fan 255 and line 256 for absorption in absorber 231.

The sulfur dioxide from line 278 is scrubbed in fortification absorber 234 with sodium sulfite solution supplied through line 236 or sodium bisulfite solution supplied through line 270 or a combination supplied through line 237 to spray nozzle 280 to scrub and recover the sulfur dioxide in packing chamber 281 to form sodium bisulfite or sodium acid sulfite. The flue gas is vented through line 282 to absorber 231.

The sodium bisulfite or sodium acid sulfite formed is discharged through line 283 by pump 284 through line 285. A portion may be discharged through valve 267 and line 202 for use in the high pressure decarbonator 210. A portion or all of the sodium bisulfite or sodium acid sulfite solution produced is sent through line 268 for use as cooking acid in the digesters.

Normally about 50% of the sulfur from sodium bisulfite cooking will be released during spent liquor combustion as sulfur dioxide. This and the smelt composition will vary with chemical composition of the cooking solution. By controlling the temperature in the reduction zone in the 800° C. to 950° C. range, sodium sulfate is first reduced to sodium sulfide, then converted to sodium carbonate releasing hydrogen sulfide that is oxidized to sulfur dioxide by excess secondary air in the oxidizing zone. This enables using sodium sulfate for makeup in the liquor burned and producing desired excess of sulfur dioxide and sodium carbonate.

The sodium carbonate content provides the needed carbon dioxide. The sodium carbonate utilized for neutralization of sodium bisulfite or sodium acid sulfite liquor provides auxiliary carbon dioxide. Sodium makeup requirements in the form of sodium carbonate can increase this excess. Using these sources of pure carbon dioxide for sodium sulfite recovery avoid the necessity of using flue gas which contains sulfur dioxide, oxygen and nitrogen that produce side reactions forming sodium thiosulfate and reduce the partial pressure available for carbonation. For neutral or alkaline sodium sulfite cooking sodium thiosulfate formation is not as detrimental and flue gas can be used in the initial precarbonation forming the sodium hydrosulfide. One half the sodium in the sodium sulfide is thus converted to sodium carbonate by the carbon dioxide reaction providing any additional carbon dioxide needed for the process.

Using pure sources of carbon dioxide for carbonation enables highly efficient carbonation. Controlling the partial pressures of carbon dioxide and hydrogen sulfide created by the solutions enables highly efficient stripping of the hydrogen sulfide.

The partial pressure of carbon dioxide created by a carbonated smelt solution in atmospheres may be expressed by the formula:

$$_pCO_2 = \frac{X^2C^{1.29}}{10S(1-X)(185-t)}$$

X is the sodium contained as sodium bicarbonate divided by the total carbonated sodium.

C is the sodium normality

S is the solubility of carbon dioxide in the water contained in gram moles per liter.

t is the temperature in degrees centigrade.

A simplified formula may be expressed by:

$$_pCO_2 = \frac{(NaHCO_3)^2 \times F_1}{Na_2CO_3}$$

The carbon dioxide partial pressure created by the solution increases by the square of the sodium bicarbonate content and by the reciprocal of the sodium carbonate content. The factor $F_1$ increases with sodium normality and temperature also increasing the partial pressure of carbon dioxide created by the solution.

The carbon dioxide partial pressure created by the solution can be held substantially above that of the gas in contact with it with only a very slow release of carbon dioxide. This phenomenon, is used in the subject invention for desulfiding by stripping with carbon dioxide without carbonation and it is believed this has never been utilized previously in the known prior art for sodium sulfite recovery.

The partial pressure of hydrogen sulfide in atmospheres created by the smelt solution may be expressed by the formula:

$$pH_2S = \frac{(NaHS) \times (NaHCO_3) \times F_2}{Na_2CO_3}$$

The partial pressure of hydrogen sulfide created by the solution increases with sodium hydrosulfide content, sodium bicarbonate content and by the reciprocal of the sodium carbonate content. The factor $F_2$ increases with temperature also increasing the partial pressure of hydrogen sulfide created by the solution.

In the initial reaction in the precarbonation stage, both carbon dioxide and hydrogen sulfide are absorbed converting the sodium sulfide to sodium hydrosulfide. By themselves these reactions without carbonation create no solution partial pressures for either carbon dioxide or hydrogen sulfide unless sodium bicarbonate is also formed. Precarbonation and carbonation by carbon dioxide absorption converting sodium carbonate to sodium bicarbonate increase the partial pressure of both carbon dioxide and hydrogen sulfide created by the solution. In the initial carbonation or precarbonation stage, low carbon dioxide gas percentage or partial pressure can be used as there is very low partial pressure created by the solution due to the low sodium bicarbonate content. This permits large quantities of carbon dioxide to be used for stripping hydrogen sulfide, with the hydrogen sulfide, carbon dioxide mixture then used for precarbonation where the absorption of carbon dioxide concentrates the hydrogen sulfide before it is vented to the sulfur burner.

Precarbonation can be carried out in a circulating reactor, mixer, plate or packed countercurrent tower. The preferred embodiment is a countercurrent tower wherein the smelt solution at temperatures in the 30° C. to 50° C. range enter the top of the tower and contact a hydrogen sulfide, carbon dioxide gas mixture to form sodium hydrosulfide. The hydrogen sulfide vented can contain 10% to 40% carbon dioxide and be efficiently burned in the sulfur burner. From 40% to 75% of the sodium carbonate contained in the smelt solution being precarbonated, can be converted to sodium bicarbonate using the carbon dioxide from subsequent stripping with the carbon dioxide concentration reduced from 50% range to the 25% range in the hydrogen sulfide vented from the precarbonator. Intermediate cooling can be used in the tower to increase the degree of carbonation possible. Some hydrogen sulfide may be released in precarbonation, however sodium bicarbonate formation should be limited to its solubility range to avoid crystallization in the precarbonator.

Precarbonation is an economically desirable addition to the process although it is not theoretically essential. It reduces high pressure carbonation and recirculation requirements for stripping and concentrates the stripped hydrogen sulfide for burning. Without it, conversion of the sodium sulfide to sodium hydrosulfide would have to take place in the top of the desulfiding stripper and delay the stripping action.

In prior art patents where sodium bicarbonate has been contained or recycled to facilitate desulfiding by contacting with carbon dioxide, the sodium carbonate has been formed by flue gas or with carbon dioxide at partial pressures of only a fraction of one atmosphere similar to that used in the precarbonation stage of the subject invention. These low carbon dioxide partial pressures only convert 50 to 75% of the carbonated sodium contained to sodium bicarbonate.

The carbon dioxide partial pressure requirements for added carbonation increase with the square of the sodium bicarbonate content and the reciprical of the sodium carbonate content causing a rapid increase in the carbon dioxide partial pressure requirements to convert the sodium bicarbonate content of the carbonated sodium to the 90% range.

Sodium bicarbonate contents above the 75% range are needed however to fully release the hydrogen sulfide with sodium bicarbonate. The hydrogen sulfide partial pressure created by the solution increases directly with the sodium bicarbonate content however, sodium bicarbonate is consumed by the desulfiding reaction causing a reduction in the hydrogen sulfide partial pressure. It is also reduced by increasing the sodium carbonate content and sodium carbonate is formed by the desulfiding reaction.

Under these conditions when the sodium bicarbonate is produced at partial pressures below one atmosphere there is not sufficient sodium bicarbonate produced in the solution to complete the desulfiding reaction. For this reason prior art patents carry out the desulfiding in carbonation towers where carbon dioxide must be absorbed to replace the sodium bicarbonate consumed and increase the solution partial pressure of hydrogen sulfide sufficiently for release. Absorption temperature must be retained low to facilitate absorption which is detrimental to hydrogen sulfide stripping and the sodium bicarbonate formed under these conditions crystallizes causing scaling or plugging problems.

Where carbon dioxide partial pressures above one atmosphere have been utilized for carbonation in prior art patents, desulfiding has either been carried out in the same tower as carbonation or the product containing high concentrations of sodium bicarbonate has been vacuum evaporated to release the hydrogen sulfide. Neither method provides complete desulfiding.

In the object invention, the solution is stripped with carbon dioxide in No. 1 desulfiding stripper without carbonation with 65 to 100% of the stripped solution going through separate carbonation. Carbonation can take place with pure carbon dioxide at atmospheric pressure and provide the degree of carbonation required however the recirculation rates and heating requirements become excessive and for this reason, carbon dioxide pressures above 1.2 atmospheres are recommended. A carbonated product is then produced with over 90% of the carbonated sodium in the form of sodium bicarbonate. From 3 to 10 times as much carbonated product is recycled as the precarbonated solution mixed with it and sent to the top of No. 1 desulfiding stripper. The carbonated solution is also heated to the 65° C. to 100° C. range. These conditions provide the mixed solution with the partial pressures of both carbon dioxide and hydrogen sulfide created by the solutions maintained well above those provided by the gases used for stripping causing both hydrogen sulfide and carbon dioxide to be released from the solution. The reaction releasing the hydrogen sulfide is much more rapid than the slow reaction releasing carbon dioxide and the gas released will be from 90% to 98% hydrogen sulfide. Reaction time is also limited and the carbon dioxide partial pressure created by the solution is never lowered to that provided by the gas due to the phenomenon of the extremely slow release of carbon dioxide.

Stripping is preferably carried out in a countercurrent packed tower. Both carbon dioxide and water vapor are used for stripping. The water vapor heats the solution to 65° C. to 100° C. range increasing the solution partial pressures and the water vapor partial pressures in the gas thereby reducing the gas partial pressures of the hydrogen sulfide and carbon dioxide. The hydrogen sulfide content in the gas can be reduced essentially to zero at the bottom of the tower if sufficient sodium bicarbonate at sufficiently high concentration is circulated. This maintains the partial pressures of hydrogen sulfide as well as the carbon dioxide created by the solution above that in the gas to assure complete removal of the sulfides and prevent carbonation or any sodium bicarbonate formation in the stripper. The hydrogen sulfide and carbon dioxide released from the stripper are preferably cooled in a condenser to the 40° C. range before being used for precarbonation.

At least 70% of the stripped solution is cooled in a heat exchanger to the 40° C. to 60° C. range and sent to carbonation. To provide a carbonated solution with the high sodium bicarbonate content needed to prevent carbonation during stripping, carbonation is carried out using carbon dioxide at pressures above 1.2 atmospheres provided by the decarbonation step and, if needed, by the neutralization step. While carbonation can be carried out in a countercurrent tower, the preferred embodiment for the present invention is the single stage pressure carbonator shown in FIG. 2 where at least 90% of the carbonated sodium can be converted to sodium bicarbonate using controlled crystallization to avoid scaling problems. This permits single stage carbonation with carbon dioxide recycled to permit complete utilization and efficient formation of the high concentration of sodium bicarbonate required.

When the highly carbonated product containing sodium bicarbonate crystals is heated to the 60° C. to 80° C. range in the heat exchanger going to No. 1 desulfiding stripper sodium bicarbonate crystals are dissolved thereby increasing the sodium bicarbonate percentage in solution. A portion or all of this carbonated solution is then mixed with the precarbonated solution and fed to No. 1 desulfiding stripper. A portion of the product from No. 1 desulfiding stripper or a portion of the product from carbonation or a combination thereof can be used as the product going to the No. 2 desulfiding stripper, the carbon dioxide release chamber for decomposition, or can be used directly in the decarbonation step.

Although substantially complete removal of the sulfides can be carried out in the No. 1 desulfiding stripper, the circulation requirements, heating requirements and carbonation requirements are reduced considerably by adding No. 2 desulfiding stripper. The sodium bicarbonate content in the feed to No. 2 desulfiding stripper can be varied by the proportion of carbonated product from the carbonation step and the No. 1 desulfiding stripper product used. The partial pressure of carbon dioxide and hydrogen sulfide created by the solution are thereby controlled and held well above that provided by the gas used for stripping. The relatively low flow is economically heated to the 90° C. to 100° C. range increasing the water vapor partial pressure to near maximum and thereby decreasing the gas carbon dioxide and hydrogen sulfide partial pressures. The depleted hydrogen sulfide content with its gas partial pressure reduced essentially to zero is stripped by the increased concentration of carbon dioxide and water that is provided from the decomposition step, the decarbonation step and/or the neutralization step.

A packed or plate tower can be utilized for stripping. By maintaining a sufficient sodium bicarbonate content in the feed solution, a partial pressures of carbon dioxide above one atmosphere is created by the solution in the top of the tower. This also assures maintaining a hydrogen sulfide partial pressure created by the solution above that in the gas so the sodium bicarbonate is utilized primarily to release the hydrogen sulfide and only a small amount is consumed in the release of carbon dioxide.

A portion of the carbon dioxide, water vapor and heat required for desulfiding can be provided by heating the stripped product to the 125° C. to 250° C. range under pressure to decompose the sodium bicarbonate and release the carbon dioxide. A holdup time of up to 30 minutes may be required depending on the temperature used. Heating can be by indirect steam heating or by direct steam injection to avoid scaling problems encountered on indirect heat exchangers. The heated solution and carbon dioxide are then discharged to a flash tank operating at near atmospheric pressure and the solution cooled to the 100° C. range by evaporation, releasing the water vapor and carbon dioxide used for desulfiding. Where sodium carbonate is used for neutralization, digester cooking or for causticizing, decomposition enables recovery of the extra carbon dioxide contained in the sodium bicarbonate.

Pressure decarbonation utilizes the chemical reaction between the solution of sodium carbonate and sodium bicarbonate from desulfiding or carbonation, with the sodium bisulfite solution from absorption, and/or from the fortification absorber, to form sodium sulfite and release carbon dioxide under pressure. The sodium bisulfite solution can be heated to the 100° C. range to increase the carbonation pressure and the amount of carbon dioxide released. A compressor may also be used to provide pressure requirements, reduce the decarbonation pressure and increase the amount of carbon dioxide released for pressure carbonation.

The preferred embodiments include combining the flows containing sodium carbonate, sodium bicarbonate and sodium bisulfite in an inline mixer and to a separator as shown in FIG. 3. The carbon dioxide is vented at pressures above 1.2 atmospheres for use in carbonation. The sodium sulfite solution is discharged through an overflow and reducing valve to atmospheric decarbonation for recovery of additional carbon dioxide at lower pressure for desulfiding. The carbon dioxide can also be compressed for use in carbonation.

The sodium carbonate from decomposition, or desulfiding can be utilized for neutralization of the spent liquor from sodium bisulfite or sodium acid sulfite applications to neutralize the acetic acid in the spent liquor and release carbon dioxide from the sodium carbonate. Neutralization can be carried out in a mixing tank however the preferred embodiments would include combining the flows of liquor and sodium carbonate solution in an inline mixer and a separator. The carbon dioxide can be released at pressures above 1.2 atmospheres for use in carbonation. The solution may also be vented to a flash tank at lower pressure with the carbon dioxide released for desulfiding.

The sodium carbonate from decomposition or from desulfiding, can also be causticized to form sodium hydroxide for use in alkaline sulfite applications. The sodium carbonate and/or sodium bicarbonate solution is utilized in a slaker to slake calcium oxide in the conventional manner with the solution and slurry going to conventional causticizing tanks and to conventional clarification where the calcium carbonate formed is removed at the bottom and clarified sodium hydroxide is removed at the top for use in making liquor or to control the pH of cooking in the digester. This step is needed only when sodium hydroxide is used for cooking.

Absorption of the sulfur dioxide from liquor combustion flue gas is carried out in the conventional manner at temperatures in the 35° C. to 95° C. range. In the preferred embodiment a conventional packed countercurrent tower is used. The packed tower can be preceeded with a venturi scrubber for particulate removal. A portion of the sodium bisulfite solution formed in the absorber or a portion of the sodium sulfite solution from decarbonation, or a combination can be the product going to the acid system for use in the digestors. It can also be acidified further by fortification.

The sulfur burner is conventional equipment and can burn makeup sulfur along with the hydrogen sulfide venting from precarbonation. A pilot burner, using auxiliary fuel or igniter may be used to insure combustion of hydrogen sulfide, with the sulfur dioxide produced going to either the absorber or the fortification tower. The hydrogen sulfide can also be burned in the liquor combustion chamber.

In fortification, the sodium sulfite and/or sodium bisulfide solution from decarbonation or absorption is utilized in a conventional countercurrent packed tower to scrub the sulfur dioxide produced in the sulfur burner. The acidified product may then go to the acid system for use in digestor cooking. A portion of the acidified product may also be sent to the pressure decarbonator.

With this invention, control of any desired pH for cooking in the digester is possible from the decarbonation and absorption recycle systems. The discharge from the decarbonator is primarily sodium sulfite with a pH as high as 7.0 while the sodium bisulfite formed in the spent liquor flue gas absorber has a pH as low as 5.0. Either is a source of acid for cooking operations and a combination can be utilized to meet any particular requirement. If desired, stronger acids may be obtained by using sulfur dioxide from sulfur burning to further acidify the sodium sulfite or sodium bisulfite solution from the spent liquor absorption system in the acid make-up fortification tower for acid sulfite systems.

For neutral sulfite systems the pH requirements are within the range of operation of the spent liquor flue gas absorption system. Higher pH can be obtained by mixing with sodium carbonate from decarbonation, or sodium hydroxide from causticizing. This enables replacement of Kraft cooking liquor with alkaline sodium sulfite eliminating the Kraft odor problems.

A variety of equipment may be utilized in the methods defined in this invention. The precarbonation, stripping without carbonation, carbonation, decomposition, pressure decarbonation, sulfur burning and sulfur dioxide absorption equipment can all be varied to accommodate the methods defined in this invention.

While specific embodiments of the invention concept and operating concentrations and temperatures are set forth herein, it is understood that the invention is not to be construed as limited thereby and that suitable modifications and variations may be made without departing from the spirit and scope of the invention as defined in the appended claims.

What I claim is:

1. An improved method for the recovery of sodium and sulfite components from the smelt derived from spent sodium sulfite and sodium bisulfite cooking liquor and the preparation of fresh liquor therefrom in which the spent liquor is burned under reduction conditions to a smelt comprised primarily of sodium sulfide and sodium carbonate, the smelt is dissolved in water, the resulting solution clarified, and the clarified solution then processed by the steps of:

(1) precarbonating the said clarified smelt solution with a gas comprising hydrogen sulfide, carbon dioxide and water vapor to convert the sodium sulfide component to sodium hydrosulfide and sodium carbonate, and a portion of the sodium carbonate component to sodium bicarbonate while absorbing a portion of the carbon dioxide and concentrating the hydrogen sulfide which is then released; (2) desulfiding the precarbonated solution by stripping said precarbonated solution with gas containing carbon dioxide and water vapor, to reduce the partial pressure of the hydrogen sulfide which is released from the precarbonated solution during desulfiding and raise the temperature of the precarbonated solution by condensation, while reacting the precarbonated solution with a concentrated sodium bicarbonate solution in which the concentration of sodium bicarbonate is maintained sufficiently high to hold the partial pressure of the carbon dioxide created by the reacted concentrated sodium bicarbonate and precarbonated solutions above the partial pressure of the carbon dioxide provided by the gas utilized for stripping during the stripping operation, thereby preventing carbonation or formation of sodium bicarbonate by carbon dioxide absorption during said stripping, while converting the sodium hydrosulfide in said reacted solution to sodium carbonate, venting said relased hydrogen sulfide and a portion of the carbon dioxide and water vapor used for said stripping for use in step one; (3) pressure carbonating at least a portion of the sodium carbonate obtained in step two with carbon dioxide maintained at a pressure above 1.2 atmospheres to convert said portion into a solution with a high concentration of sodium bicarbonate and recycling at least a portion of the high concentration sodium bicarbonate solution to step two; (4) decarbonating a portion of the solution from step two containing sodium carbonate and sodium bicarbonte by reacting with sodium bisulfite at a pressure above 1.2 atmospheres to form sodium sulfite and carbon dioxide at pressures above 1.2 atmospheres and recycling the pressurized carbon dioxide to step three; (5) reacting the sodium sulfite formed in step four with sulfur dioxide to form sodium bisulfite suitable for use in cooking liquor.

2. The method of claim 1, wherein the pressure carbonation step three is carried out at sufficiently high carbon dioxide partial pressure to convert at least 90% of the carbonated sodium in the resulting solution to sodium bicarbonate and the amount of resulting solution which is recycled to step two from step three is at least three times the amount of the precarbonated solution from step one which is being reacted.

3. The method set forth in claim 1, wherein a portion of the sodium bicarbonate formed in step three is concentrated sufficiently to form sodium bicarbonate crystals which are subsequently dissolved by heating the solution to increase the sodium bicarbonate in solution and thereby, increase the carbon dioxide partial pressure created by said reacted solution in step two.

4. The method set forth in claim 1, wherein a portion of the reacted solution obtained from stripping in step two, which is decarbonated in step four, is stripped a second time with carbon dioxide and water vapor before said portion is decarbonated in step four.

5. The method set forth in claim 1, wherein the portion of the product from carbonation in step three that is not reacted in step two is stripped a second time with carbon dioxide and water vapor and the product from said second stripping operation is reacted in step four.

6. The method set forth in claim 5, wherein the product sent to the second stripping operation is of sufficiently high concentration of sodium bicarbonate to hold the partial pressure of carbon dioxide created by the concentrated sodium bicarbonate solution above that provided by the gas utilized for stripping during the stripping operation, thereby preventing carbonation or formation of sodium bicarbonate by carbon dioxide absorption during said second stripping.

7. The method of claim 1, wherein the stripped product from step two is heated under pressure to above 125° C. to decompose the sodium bicarbonate contained and form sodium carbonate and carbon dioxide, and the sodium carbonate is discharged to a lower pressure to release carbon dioxide and water vapor for use in stripping step two.

8. The method of claim 1, wherein the released hydrogen sulfide from step one is oxidized to sulfur dioxide and said sulfur dioxide is used to react with the sodium sulfite in step five.

9. The method of claim 1, wherein a portion of the sodium bisulfite obtained in step five is recycled for use in step four.

10. The method of claim 1, wherein sulfur dioxide released in the reduction burning of said spent sodium sulfite cooking liquor is reacted with sodium sulfite in step five.

11. The method of claim 1, wherein a portion of the sodium sulfite formed in step four is withdrawn for use as cooking liquor.

12. The method of claim 1, wherein a portion of the sodium bisulfite formed in step five is withdrawn for use as cooking liquor.

13. The method of claim 7, wherein a portion of the said formed sodium carbonate is withdrawn for use as cooking liquor.

14. The method of claim 7, wherein a portion of the said formed sodium carbonate is causticized to form sodium hydroxide for use in alkaline sulfite cooking liquor.

15. The method of claim 7, wherein spent sodium sulfite cooking liquor before evaporation and burning is contacted with a portion of said sodium carbonate discharged at pressures above 1.2 atmospheres to neutralize the said spent sodium sulfite cooking liquor, relasing the carbon dioxide formed at pressures above 1.2 atmospheres, using a portion of the carbon dioxide in step three and venting at a lower pressure to release a portion of the carbon dioxide for use in step two.

16. The method set forth in claim 7, wherein a portion of the said formed sodium carbonate is reacted with sulfur dioxide released in the reduction burning of said spent sodium sulfite liquor.

17. The method of claim 1, wherein the decarbonated product from step four is vented at lower pressures to release carbon dioxide for use in step two.

* * * * *